US007163475B2

(12) United States Patent
Giannetti

(10) Patent No.: US 7,163,475 B2
(45) Date of Patent: Jan. 16, 2007

(54) BALL BAT EXHIBITING OPTIMIZED PERFORMANCE VIA DISCRETE LAMINA TAILORING

(75) Inventor: William B. Giannetti, Winnetka, CA (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

(21) Appl. No.: 11/034,993

(22) Filed: Jan. 12, 2005

(65) Prior Publication Data

US 2006/0025250 A1 Feb. 2, 2006

Related U.S. Application Data

(63) Continuation-in-part of application No. 10/903,493, filed on Jul. 29, 2004.

(51) Int. Cl.
*A63B 59/06* (2006.01)

(52) U.S. Cl. ..... 473/567

(58) Field of Classification Search ..... 473/564–568, 473/457, 519, 520
See application file for complete search history.

(56) References Cited

U.S. PATENT DOCUMENTS

| | | | | |
|---|---|---|---|---|
| 1,611,858 | A | 12/1926 | Middlekauff | |
| 4,848,745 | A * | 7/1989 | Bohannan et al. | 473/119 |
| 4,931,247 | A | 6/1990 | Yeh | |
| 5,131,651 | A * | 7/1992 | You | 473/520 |
| 5,301,940 | A | 4/1994 | Seki et al. | |
| 5,303,917 | A | 4/1994 | Uke | |
| 5,364,095 | A | 11/1994 | Easton et al. | |
| 5,395,108 | A | 3/1995 | Souders et al. | |
| 5,415,398 | A | 5/1995 | Eggiman | |
| 5,511,777 | A | 4/1996 | McNeely | |
| 5,593,158 | A | 1/1997 | Filice et al. | |
| 5,624,115 | A | 4/1997 | Baum | |
| 5,676,610 | A | 10/1997 | Bhatt et al. | |
| 5,759,113 | A | 6/1998 | Lai et al. | |
| 5,899,823 | A | 5/1999 | Eggiman | |
| 5,964,673 | A | 10/1999 | MacKay, Jr. | |
| 6,042,493 | A | 3/2000 | Chauvin et al. | |
| 6,053,828 | A | 4/2000 | Pitsenberger | |
| 6,344,007 | B1 | 2/2002 | Feeney et al. | |
| 6,352,485 | B1 | 3/2002 | Philpot et al. | |
| 6,383,101 | B1 | 5/2002 | Eggiman et al. | |
| 6,398,675 | B1 | 6/2002 | Eggiman et al. | |
| 6,425,836 | B1 | 7/2002 | Misono et al. | |
| 6,440,017 | B1 | 8/2002 | Anderson | |
| 6,461,260 | B1 | 10/2002 | Higginbotham | |
| 6,497,631 | B1 | 12/2002 | Fritzke et al. | |

(Continued)

OTHER PUBLICATIONS

Mustone, et al., "Using LS-DYNA to Develop a Baseball Bat Performance and Design Tool," 6th International LS-DYNA Users Conference, Apr. 9-10, Detroit, MI.

(Continued)

*Primary Examiner*—Mark S. Graham
(74) *Attorney, Agent, or Firm*—Perkins Coie LLP

(57) ABSTRACT

A ball bat exhibits improved barrel performance in regions located away from the "sweet spot" of the bat barrel, as a result of discrete lamina tailoring in those regions. One or more layers, or laminae, in regions of the bat barrel away from the sweet spot, are tailored to increase the radial compliance, or reduce the radial stiffness, of the bat barrel in those regions, so that they perform more like the sweet spot of the barrel. Additionally, or alternatively, one or more laminae in the bat handle and/or the tapered section of the bat may be tailored to increase the radial compliance in those regions.

20 Claims, 4 Drawing Sheets

U.S. PATENT DOCUMENTS

| | | | | |
|---|---|---|---|---|
| 6,508,731 | B1 | 1/2003 | Feeney et al. | |
| 6,663,517 | B1 | 12/2003 | Buiatti et al. | |
| 6,729,983 | B1 | 5/2004 | Vakili et al. | |
| 6,764,419 | B1 | 7/2004 | Giannetti et al. | |
| 6,776,735 | B1 * | 8/2004 | Belanger et al. | 473/567 |
| 6,863,628 | B1 | 3/2005 | Brandt | |
| 2001/0014634 | A1 | 8/2001 | MacKay, III | |
| 2002/0091022 | A1 * | 7/2002 | Frotzle et al. | 473/566 |
| 2002/0151392 | A1 | 10/2002 | Buiatti et al. | |
| 2004/0176197 | A1 | 9/2004 | Sutherland | |
| 2005/0070384 | A1 * | 3/2005 | Fitzgerald et al. | 473/567 |
| 2005/0143203 | A1 | 6/2005 | Souders et al. | |
| 2005/0227795 | A1 * | 10/2005 | Fritzke | 473/564 |

OTHER PUBLICATIONS

Combined International Search Report and Written Opinion of the International Searching Authority for International Application No. PCT/US05/26872; issued by the ISA/US;dated Dec. 5, 2005.

* cited by examiner

Fig. 2
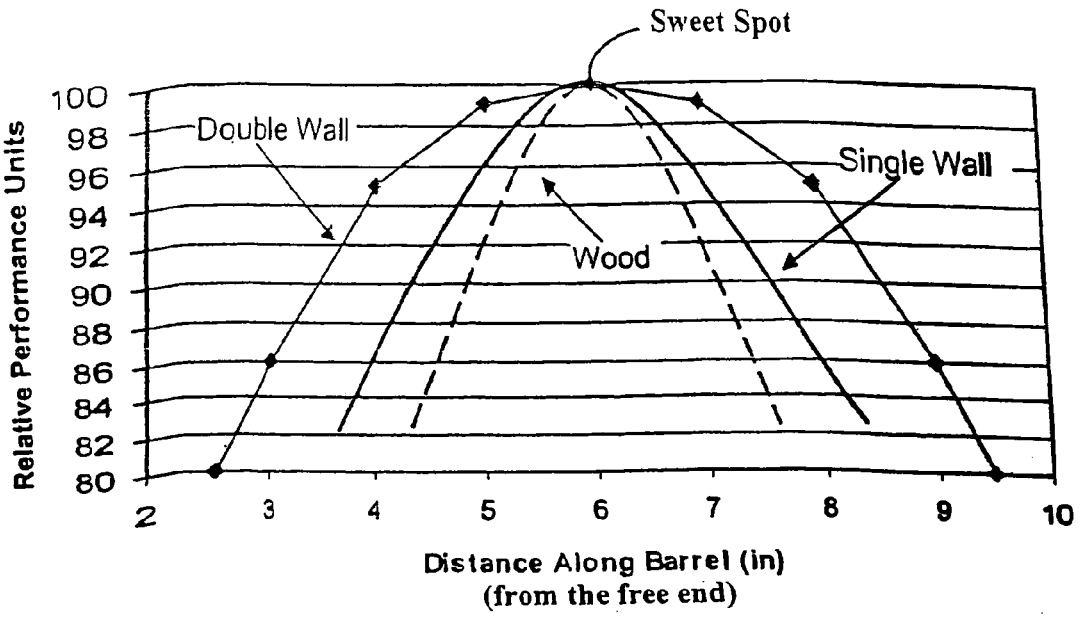
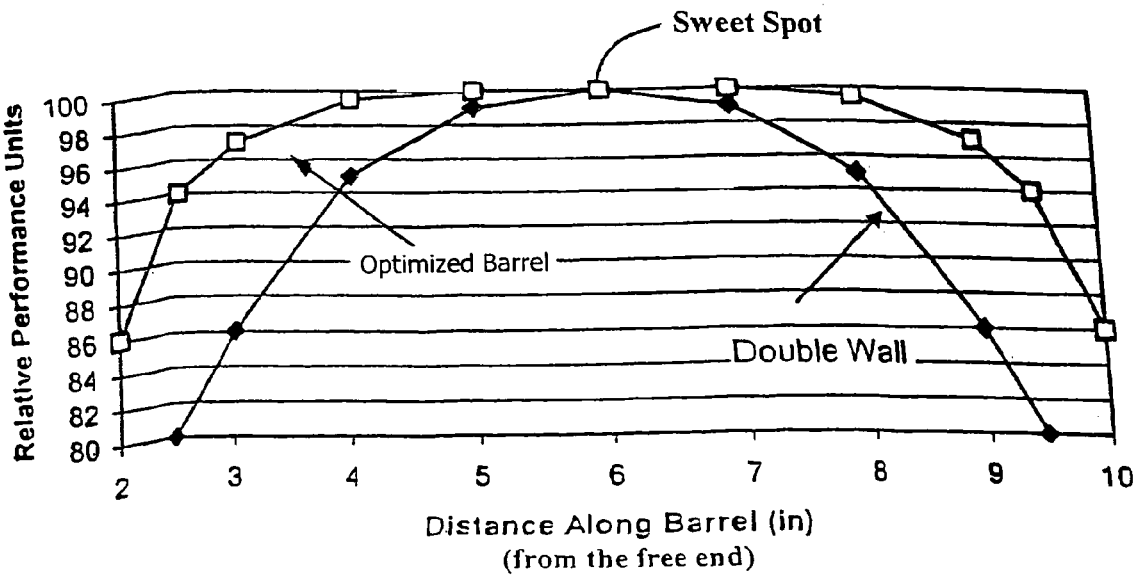
Fig. 6

Fig. 3
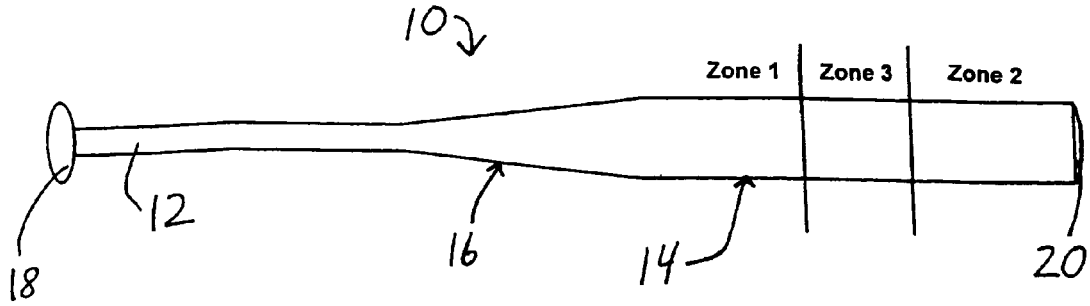
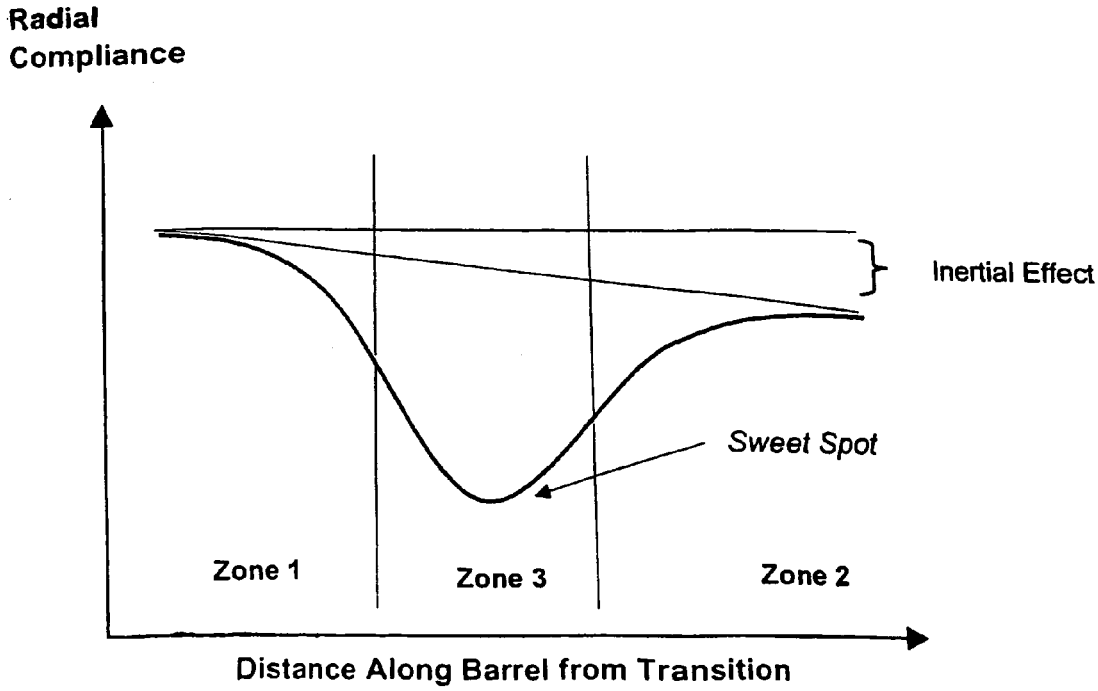
Fig. 4

Fig. 5A
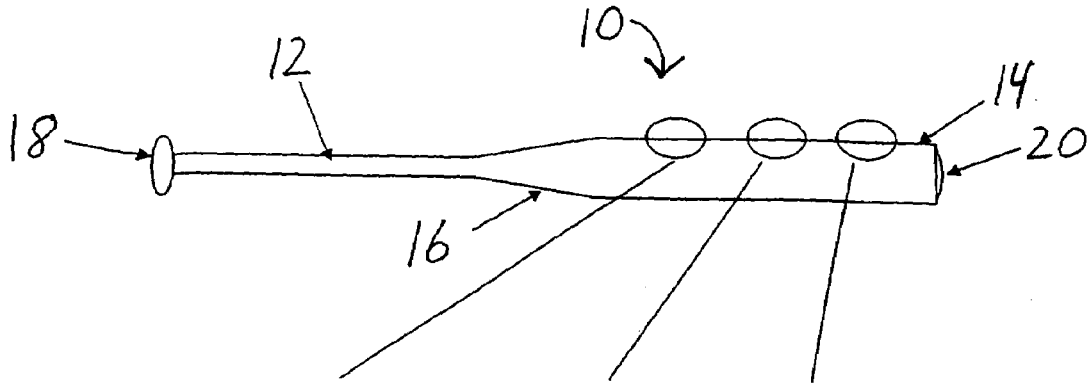
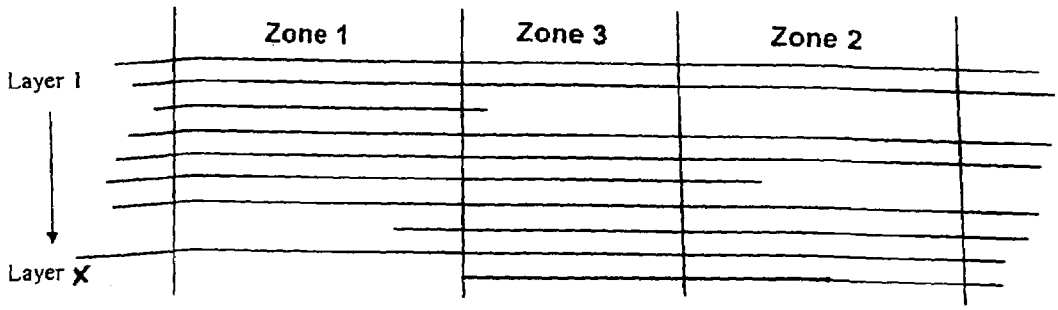
Fig. 5B

BALL BAT EXHIBITING OPTIMIZED PERFORMANCE VIA DISCRETE LAMINA TAILORING

This application is a Continuation-In-Part of U.S. patent application Ser. No. 10/903,493, filed Jul. 29, 2004, which is herein incorporated by reference.

BACKGROUND OF THE INVENTION

Baseball and softball bat manufacturers are continually attempting to develop ball bats that exhibit increased durability and improved performance characteristics. Ball bats typically include a handle, a barrel, and a tapered section joining the handle to the barrel. The outer shell of these bats is generally formed from aluminum or another suitable metal, and/or one or more composite materials.

Barrel construction is particularly important in modern bat design. Barrels having a single-wall construction, and more recently, a multi-wall construction, have been developed. Modern ball bats typically include a hollow interior, such that the bats are relatively lightweight and allow a ball player to generate substantial "bat speed" or "swing speed."

Single-wall bats generally include a single tubular spring in the barrel section. Multi-wall barrels typically include two or more tubular springs, or similar structures, that may be of the same or different material composition, in the barrel section. The tubular springs in these multi-wall bats are typically either in contact with one another, such that they form friction joints, are bonded to one another with weld or bonding adhesive, or are separated from one another forming frictionless joints. If the tubular springs are bonded using a structural adhesive, or other structural bonding material, the barrel is essentially a single-wall construction. U.S. Pat. No. 5,364,095, the disclosure of which is herein incorporated by reference, describes a variety of bats having multi-walled barrel constructions.

It is generally desirable to have a bat barrel that is durable, while also exhibiting optimal performance characteristics. Hollow bats typically exhibit a phenomenon known as "trampoline effect," which essentially refers to the rebound velocity of a ball leaving the bat barrel as a result of dynamic coupling between the bat and the ball. It is desirable to construct a ball bat having a high "trampoline effect," so that the bat may provide a high rebound velocity to a pitched ball upon contact.

The "trampoline effect" is a direct result of the matching of fundamental frequencies between the bat and the ball (dynamic coupling), and the resulting compression and strain recovery of the bat barrel. During this process of barrel compression and decompression, energy is transferred to the ball resulting in an effective coefficient of restitution (COR) of the ball, which is the ratio of the post impact ball velocity to the incident ball velocity (COR=Vpost impact/Vincident). In other words, in general, the COR of the ball improves as the "trampoline effect" increases.

Multi-walled bats were developed in an effort to increase the amount of acceptable barrel deflection beyond that which is possible in typical single-wall and solid wood designs. These multi-walled constructions generally provide added barrel deflection, without increasing stresses beyond the material limits' of the barrel materials. Accordingly, multi-wall barrels are typically more efficient at transferring energy back to the ball. In general, multi-walled bats accomplish higher performance by lowering the barrel stiffness through decoupling of the shear interfaces between the barrel layers. The lower barrel stiffness decreases the highly inefficient ball deformation and increases barrel deformation. Barrel deformation is more efficient in returning the impact energy to the ball, thus resulting in improved performance.

An example of a multi-wall ball bat 100 is illustrated in FIG. 1. The barrel 102 of the ball bat 100 includes an inner wall 104 separated from an outer wall 106 by an interface shear control zone ("ISCZ") 108 or layer, such as an elastomeric layer, a friction joint, a bond-inhibiting layer, or another suitable shear-controlling zone or layer. Each of the inner and outer walls 104, 106 typically includes one or more plies 110 of one or more fiber-reinforced composite materials. Additionally, or alternatively, one or both of the inner and outer walls 104, 106 may include a metallic material, such as aluminum.

One way that a multi-wall bat differs from a single-wall bat is that there is no shear energy transfer through the ISCZ(s) in the multi-wall barrel, i.e., through the region(s) between the barrel walls that de-couple the shear interface between those walls. As a result of strain energy equilibrium, this shear energy, which creates shear deformation in a single-wall barrel, is converted into bending energy in a multi-wall barrel. And since bending deformation is more efficient in transferring energy than is shear deformation, the walls of a multi-wall bat typically exhibit a lower strain energy loss than does a single wall design. Thus, multi-wall barrels are generally preferred over single-wall barrels for producing efficient bat-ball collision dynamics, or more efficient dynamic coupling "trampoline effect."

To illustrate, FIG. 2 shows a graphical comparison of the relative performance characteristics of a typical wood bat barrel, a typical single-wall bat barrel, and a typical double-wall bat barrel. As FIG. 2 illustrates, double-wall bats generally perform better along the length of the barrel than do single-wall bats and wood bats. While double-wall bats have generally produced improved results along the barrel length, these results still decrease as impact occurs away from the barrel's "sweet spot."

The sweet spot is the impact location in the barrel where the transfer of energy from the bat to the ball is maximal, while the transfer of energy to a player's hands is minimal. The sweet spot is generally located at the intersection of the bat's center of percussion (COP), and the superposition of the first three axial fundamental modes of vibration. This location, which is typically about 4 to 8 inches from the free end of the barrel (it is shown at 6 inches from the free end of the barrel in FIG. 2, by way of example only), does not move when the bat is vibrating in its fundamental bending modes. As a result, when a ball impacts the sweet spot, the bat vibration energy loss is minimal, and a player swinging the bat does not feel vibration.

The barrel regions between the sweet spot and the free end of the barrel, and between the sweet spot and the tapered section (and beyond) of the bat, in particular, do not exhibit the optimal performance characteristics that occur at the sweet spot, due to energy loss resulting from vibration and rotational inertia effects. Indeed, as shown in FIG. 2, in a typical ball bat, the barrel performance decreases considerably as the impact location moves away from the sweet spot. As a result, a player is required to make very precise contact with a pitched ball, which is generally very challenging to do, to achieve optimal results and to avoid stinging bat vibration. Thus, a need exists for a ball bat that exhibits improved performance at regions of the ball bat away from the sweet spot. Additionally, a need exists for an improved single-wall bat that exhibits improved performance characteristics.

SUMMARY OF THE INVENTION

The invention is directed to a ball bat that exhibits improved performance in regions located away from the sweet spot of the bat barrel, as a result of discrete lamina tailoring in those regions. In general, one or more layers, or laminae, in regions of the bat barrel away from the sweet spot, are tailored to increase the radial compliance, i.e., to reduce the radial stiffness, of the bat barrel in those regions, so that they perform more like the sweet spot of the barrel, through improved barrel mechanics. Additionally, or alternatively, one or more laminae in the bat handle and/or the tapered section of the bat may be tailored to increase (or decrease) the radial compliance in those regions.

In one aspect, one or more laminae in the region of the bat barrel between the sweet spot and the tapered section of the bat are tailored to significantly increase the radial compliance, or reduce the radial stiffness, of that region of the barrel. To a lesser extent, one or more laminae between the sweet spot and the free end of the bat are tailored to increase the radial compliance, or reduce the radial stiffness, in that region of the barrel. Accordingly, radial compliance is increased to a greater extent between the sweet spot and the tapered section, than between the sweet spot and the free end of the barrel, to account for the different effects of rotational inertia in those barrel regions.

In another aspect, a ball bat includes a first region in the barrel, adjacent to the tapered section, having a first radial stiffness, a second region in the barrel, adjacent to a free end of the barrel, having a second radial stiffness, and a third region in the barrel, between the first and second regions, having a third radial stiffness that is greater than at least one of the first and second radial stiffnesses.

In another aspect, the third radial stiffness is greater than the second radial stiffness, and the second radial stiffness is greater then the first radial stiffness.

In another aspect, the first, second, and third barrel regions all include the same material. Plies of the material are oriented at different angles relative to the longitudinal axis of the bat, in each of the first, second, and third regions, such that the radial stiffness of the barrel varies in each of the first, second, and third regions.

In another aspect, plies in the first region are oriented at a lesser angle from a longitudinal axis of the bat than plies in the second region, and plies in the second region are oriented at a lesser angle from the longitudinal axis of the bat than plies in the third region.

In another aspect, a thickness of at least one barrel wall is less in the first region than in the third region.

In another aspect, a thickness of at least one barrel wall is less in the second region than in the third region.

In another aspect, the radial stiffness in the first region is less than 1000 pounds per inch, and the radial stiffness in the second region is less than 2000 pounds per inch.

In another aspect, the radial stiffness in the third region is at least three times greater than the radial stiffness in the first region.

In another aspect, the radial stiffness in the third region is at least 1.5 times greater than the radial stiffness in the second region.

In another aspect, different materials, having different radial stiffness properties, are located in at least two of the first, second, and third regions.

In another aspect, the barrel comprises at least one composite material selected from the group consisting of glass, graphite, boron, carbon, aramid, and ceramic.

In another aspect, the first region in the barrel extends into the tapered section of the ball bat.

In another aspect, the ball bat includes at least one ISCZ dividing the barrel into at least two walls.

In another aspect, a ball bat includes a first region in the barrel, adjacent to the tapered section of the bat, having a first radial stiffness, a second region in the barrel, adjacent to a free end of the bat, having a second radial stiffness, and a third region in the barrel, between the first and second regions, having a third radial stiffness. The third radial stiffness is at least 1.5 times greater than the second radial stiffness, and at least three times greater than the first radial stiffness.

In another aspect, the second radial stiffness is greater than the first radial stiffness.

In another aspect, the second radial stiffness is at least two times greater than the first radial stiffness.

In another aspect, a ball bat includes a first zone in the barrel, adjacent to the tapered section of the bat, including at least a first radial compliance region, a second zone in the barrel, adjacent to a free end of the bat, including at least a second radial compliance region, and a third zone in the barrel, between the first and second zones.

In another aspect, the first radial compliance region reduces radial stiffness in the bat barrel to a greater extent than does the second radial compliance region.

In another aspect, the ball bat includes at least a third radial compliance region in at least one of the tapered section and the handle of the ball bat.

In another aspect, the third radial compliance region is located in the handle substantially at a user grip location in the handle.

In another aspect, a ball bat includes a barrel, a handle, and a tapered section joining the barrel to the handle and having at least one radial compliance region therein.

Other features and advantages of the invention will appear hereinafter. The features of the invention described above can be used separately or together, or in various combinations of one or more of them. The invention resides as well in sub-combinations of the features described.

BRIEF DESCRIPTION OF THE DRAWINGS

In the drawings, wherein the same reference number indicates the same element throughout the several views:

FIG. 2 is a graph comparing relative performance characteristics of a typical wood bat barrel, a typical single-wall bat barrel, and a typical double-wall bat barrel.

FIG. 3 is a side view of a ball bat showing the barrel of the bat divided into three conceptual regions or zones.

FIG. 4 is a graph conceptually illustrating the amount of radial compliance required in each region of a typical bat barrel to optimize performance of the bat barrel.

FIG. 5A is side view of the ball bat shown in FIG. 3.

FIG. 5B is at least a partial cross-section of Zones 1–3 of the bat barrel shown in FIG. 5A.

FIG. 6 is a graph comparing relative performance characteristics of a typical double-wall bat barrel and an optimized bat barrel using discrete lamina tailoring.

DETAILED DESCRIPTION OF THE DRAWINGS

Figure 1:
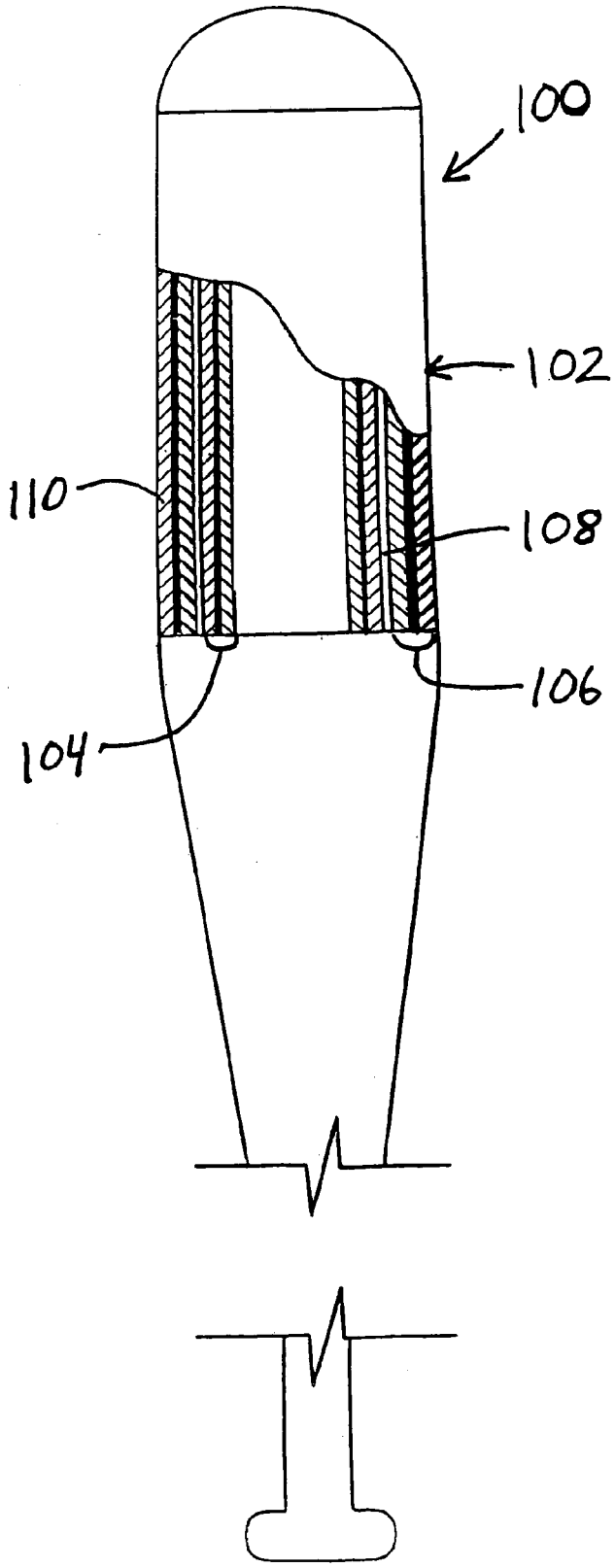
FIG. 1 is a partially cutaway view of a multi-wall ball bat.

In typical existing single-wall metal bats, material strength and isotropic behavior have limited the degree to which the bat stiffness can be altered along the longitudinal axis of the bat. Lowering the stiffness of a bat barrel near the end of the barrel, either at the cap or at the tapered section, has generally lowered the durability of the bat, due to insufficient material strength. The anisotropic strengths of composite materials, however, allow a designer to independently alter the hoop and axial stiffnesses of a bat barrel along the bat's longitudinal axis. A multi-wall composite bat may offer even larger decreases in the barrel stiffness than a single-wall design, and is therefore generally preferred. A single-wall barrel, however, can also be enhanced using the techniques described below.

Turning now in detail to the drawings, as shown in FIG. 3, a baseball or softball bat 10, hereinafter collectively referred to as a "ball bat" or "bat," includes a handle 12, a barrel 14, and a tapered section 16 joining the handle 12 to the barrel 14. The free end of the handle 12 includes a knob 18 or similar structure. The barrel 14 is preferably closed off by a suitable cap 20 or plug. The interior of the bat 10 is preferably hollow, which allows the bat 10 to be relatively lightweight so that ball players may generate substantial bat speed when swinging the bat 10.

The ball bat 10 preferably has an overall length of 20 to 40 inches, more preferably 26 to 34 inches. The overall barrel diameter is preferably 2.0 to 3.0 inches, more preferably 2.25 to 2.75 inches. Typical bats have diameters of 2.25, 2.625, or 2.75 inches. Bats having various combinations of these overall lengths and barrel diameters, as well as any other suitable dimensions, are contemplated herein. The specific preferred combination of bat dimensions is generally dictated by the user of the bat 10, and may vary greatly between users.

The bat barrel 14 may be a single-wall or a multi-wall structure. If it is a multi-wall structure, the barrel walls are preferably separated by one or more interface shear control zones (ISCZs). Any ISCZ used preferably has a radial thickness of approximately 0.001 to 0.020 inches, more preferably 0.004 to 0.006 inches. Any other suitable size ISCZ may alternatively be used.

An ISCZ may include a bond-inhibiting layer, a friction joint, a sliding joint, an elastomeric joint, an interface between two dissimilar materials (e.g., aluminum and a composite material), or any other suitable means for separating the barrel into "multiple walls." If a bond-inhibiting layer is used, it is preferably made of a fluoropolymer material, such as Teflon® (polyfluoroethylene), FEP (fluorinated ethylene propylene), ETFE (ethylene tetrafluoroethylene), PCTFE (polychlorotrifluoroethylene), or PVF (polyvinyl fluoride), and/or another suitable material, such as PMP (polymethylpentene), nylon (polyamide), or cellophane.

In one embodiment, one or more ISCZs may be integral with, or embedded within, layers of barrel material, such that the barrel 14 acts as a one-piece/multi-wall construction. In such a case, the barrel layers at at least one end of the barrel are preferably blended together to form the one-piece/multi-wall construction. The entire ball bat 10 itself may also be formed as "one piece." A one-piece bat design generally refers to the barrel 14, the tapered section 16, and the handle 12 of the bat having no gaps, inserts, jackets, or bonded structures that act to appreciably thicken the barrel wall(s). The distinct laminate layers are preferably integral to the barrel structure so that they all act in unison under loading conditions. To accomplish this one-piece design, the layers of the bat 10 are preferably co-cured, and are therefore not made up of a series of connected tubes (inserts or jackets) that each have a wall thickness at the ends of the tubes.

The blending of the barrel walls into a one-piece construction, around one or more ISCZs, like tying the ends of a leaf spring together, offers a stable, durable assembly, especially for when impact occurs at the extreme ends of the barrel 14. Bringing multiple laminate layers together assures that the system acts as a unitized structure, with no one layer working independent of the others. By redistributing stresses to the extreme ends of the barrel, local stresses are reduced, resulting in increased bat durability.

The one or more barrel walls preferably each include one or more composite plies. The composite materials that make up the plies are preferably fiber-reinforced, and may include glass, graphite, boron, carbon, aramid, ceramic, Kevlar®, metallic, and/or any other suitable structural fibrous materials, preferably in epoxy form or another suitable form. Each composite ply preferably has a thickness of approximately 0.002 to 0.060 inches, more preferably 0.003 to 0.008 inches. Any other suitable ply thickness may alternatively be used.

In one embodiment, the bat barrel 14 may comprise a hybrid metallic-composite structure. For example, the barrel may include one or more walls made of composite material(s), and one or more walls made of metallic material(s). Alternatively, composite and metallic materials may be interspersed within a given barrel wall. When the barrel includes a metal portion, such as an aluminum portion, and a composite portion, regions of the composite portion may be tailored for barrel optimization, as described in detail below. In another embodiment, nano-tubes, such as high-strength carbon nano-tube composite structures, may alternatively or additionally be used in the barrel construction.

For purposes of this description, as illustrated in FIGS. 3–5, the bat barrel 14 is divided into three conceptual regions or zones. The first region, or "Zone 1," extends approximately from the tapered section 16 of the ball bat 10 to a location near the "sweet spot" (as described above) of the bat barrel 14. The second region, or "Zone 2," extends approximately from the free end of the bat barrel 14 to a location near the sweet spot. The third region, or "Zone 3," extends between the first and second zones, and preferably includes the sweet spot of the barrel 14.

The actual dimensions and locations of these zones may vary, as may the total number of zones. Furthermore, the individual Zones may have different lengths. For example, Zone 1 may extend into the tapered section 16 of the ball bat 10, an infinite number of Zones may be delineated along the length of the barrel (and beyond), Zone 3 may be narrower than Zone 2, etc. Thus, the specific Zones 1–3 shown in the figures are used for ease of description only.

It is well known that a typical ball bat's performance lessens as hits occur away from the sweet spot of the bat barrel. In general, a ball bat's performance is less optimal the farther away from the sweet spot that a ball strikes the bat. Additionally, it is well known that the rotational inertia produced by a bat swing is greater at the free end of the bat than at the tapered section of the bat. This rotational inertia contributes to the overall performance of the bat. Thus, barrel performance, absent discrete lamina tailoring or other enhancements, is generally better in Zone 2 than in Zone 1 of a ball bat.

To optimize the barrel's performance throughout it's length, therefore, the performance of Zone 2, and especially Zone 1, of the bat barrel 14 must be improved. Increasing the radial compliance, i.e., reducing the radial stiffness, of Zones 1 and 2, is one way to improve the performance of those regions of the bat barrel 14. By increasing the radial compliance in Zones 1 and 2, relative to Zone 3, the regions of the bat barrel 14 between the tapered section and the sweet spot, and between the free end and the sweet spot, can be made to perform more like the sweet spot of the bat barrel 14.

FIG. 4 is a graph conceptually illustrating the amount of radial compliance required in Zones 1 and 2 of the bat barrel 14 to optimize the barrel's performance throughout its length, i.e., to make the performance of Zones 1 and 2 better approximate the performance of the sweet spot of the barrel 14. As shown in FIG. 4, more radial compliance, i.e., a lower radial stiffness, is required in Zone 1 than in Zone 2, due to the greater rotational inertia that occurs in Zone 2 relative to Zone 1, as described above.

In an exemplary embodiment, to optimize the performance of the bat barrel 14, i.e., to substantially equalize the performance in all three barrel Zones, the radial stiffness in Zone 1 is generally tailored to be 5% to 75% of the radial stiffness in Zone 3, and the radial stiffness in Zone 2 is generally tailored to be 10% to 90% of the radial stiffness in Zone 3. In one preferred embodiment, the radial stiffness in Zone 3 is tailored to be approximately 3000 pounds/inch, the radial stiffness in Zone 1 is tailored to be less than 1000 pounds/inch, and the radial stiffness in Zone 2 is tailored to be less than 2000 pounds per inch, as described in detail below.

The radial stiffness in each region may of course be higher or lower than these ranges, and not every region needs to be tailored to meet the compliance curve illustrated in FIG. 4. While a bat barrel meeting the compliance curve is ideally optimized, a bat barrel may be designed where radial compliance is increased (or decreased) in only one region, or in two regions, or in all three regions, and the radial compliance in any given region may be modified to a greater or lesser extent than that which is outlined in the exemplary embodiment above.

FIGS. 5A and 5B illustrate the ball bat 10, and an exemplary cross-section of at least a portion of the barrel layers of Zones 1–3, according to one embodiment. The barrel 14 may include any suitable number of composite layers, and/or layers of other material(s), and may be divided into any suitable number of walls, via one or more ISCZs, for example. Alternatively, the barrel 14 may include one single wall with no ISCZs. Furthermore, one or more Zones may be divided into two or more walls, while one or more of the other Zones may include only a single wall. Of course, any ISCZ present may terminate at any point, or extend throughout the length of the barrel 14 (or longer), and does not necessarily have to terminate where two of the conceptual Zones meet. Indeed, any ISCZ may overlap two or more Zones, and may terminate between Zones or within a single Zone, as described in detail in incorporated U.S. patent application Ser. No. 10/903,493.

Increased radial compliance, or reduced radial stiffness, may be achieved in one or more barrel regions via one or more methods. In one embodiment, individual composite layers, or plies, in the bat barrel 14 may be oriented at various angles relative to the longitudinal axis of the ball bat 10, to increase the radial compliance in one or more regions of the bat barrel 14. In general, radial compliance increases, and radial stiffness decreases, the closer to the longitudinal axis of the ball bat 10 that a ply is oriented. Thus, as the angular orientation of a ply, measured from the bat's longitudinal axis, increases, the radial compliance of that ply decreases, i.e., the radial stiffness is greatest when a ply is oriented at 90 degrees from the longitudinal axis of the ball bat 10.

Accordingly, a composite ply running the length of the barrel 14, for example, may be oriented at a lesser angle, relative to the longitudinal axis of the ball bat, in Zone 1 than in Zone 2, and in Zone 2 than in Zone 3, to optimize the compliance of that ply. For example, layer 1 in FIG. 5B (which is shown oriented at substantially zero degrees relative to the bat's longitudinal axis for ease of illustration only), may be oriented at ±/−10° in Zone 1, ±/−20° in Zone 2, and ±/−60° in Zone 3, relative to the bat's longitudinal axis. This, of course, is just one of the infinite layer-orientation combinations that are possible.

In this example, the radial stiffness of layer 1 is less in Zone 1 than in Zone 2, and less in Zone 2 than in Zone 3 (assuming that layer 1 is made of uniform material, has uniform thickness, etc.). Accordingly, the radial compliance relative to Zone 3 is increased in Zone 2, and increased even more so in Zone 1, to better approximate the performance of Zone 3 in Zones 1 and 2 (i.e., to substantially meet the compliance curve illustrated in FIG. 4).

In general, optimizing the bat barrel 14 as a whole is desired, although it may be desirable to optimize specific regions. Thus, while the concept that plies may be oriented at lesser angles, relative to the longitudinal axis of the bat 10, in regions of the bat barrel 14 requiring increased compliance, may generally be followed, each individual ply need not be oriented in such a manner to improve the overall barrel compliance. Indeed, as long as the angular orientations of the plies, relative to the longitudinal axis of the ball bat 10, in the barrel regions requiring increased radial compliance are generally smaller than those in the regions requiring less or no compliance, the relative overall radial compliance of the bat barrel 14 will generally be improved (assuming that the barrel layers are made of uniform material, have uniform thickness, etc.).

In another embodiment, the thickness of one or more barrel walls, in one or more regions of the barrel, may be reduced relative to the other barrel regions, to reduce the radial stiffness in the reduced thickness regions. For example, the thickness of a barrel wall in Zone 1 and/or Zone 2 may be reduced relative to the corresponding barrel wall thickness in Zone 3. By reducing the thickness of a barrel wall in one or both of those regions, the radial stiffness of those regions may be reduced relative to the radial stiffness in Zone 3 of the bat barrel 14.

Similar to the layer orientation embodiment described above, the barrel wall thickness may be reduced to a greater extent in Zone 1 than in Zone 2, to reduce the radial stiffness to a greater extent in Zone 1 than in Zone 2 (assuming that uniform barrel materials, layer orientations, etc. are used). As a result, the radial compliance in Zones 1 and 2 may be increased in accordance with the compliance curve illustrated in FIG. 4, to optimize the barrel performance.

In another embodiment, different materials, having different radial stiffness properties, may be located in different barrel regions, to optimize the barrel stiffness throughout the barrel 14. For example, a material having a lower radial stiffness (at a given orientation), than material(s) located in other regions of the bat barrel 14, may be positioned in portions of Zone 1 and/or Zone 2 (or portions of Zone 3, if desired) of the barrel 14 to reduce the radial stiffness in those regions relative to the other regions in the barrel 14. As with the embodiments described above, it is generally desirable to reduce the radial stiffness to a greater extent in Zone 1 than in Zone 2. Accordingly, a greater amount of material having a lower radial stiffness, at the predetermined layer orientation(s), is preferably located in Zone 1 than in Zone 2 of the bat barrel 14 to better optimize the bat barrel, according to the radial compliance curve illustrated in FIG. 4.

Similarly, a material having a higher radial stiffness (at a given orientation), than material(s) located in other regions of the bat barrel 14, may be positioned in portions of Zone 3 of the barrel 14 to increase the radial stiffness in that region relative to the other regions in the barrel 14. In general, any configuration where lower radial stiffness materials are used in regions where increased radial compliance is desired, and/or where higher radial stiffness materials are used in regions where less radial compliance is desired (e.g., to meet baseball association safety standards), is contemplated herein.

In another embodiment, any combination of the barrel optimization methods described above may be utilized to optimize the performance of the bat barrel 14. For example, one or more layers in Zone 1 and/or Zone 2 may be oriented at lesser angles relative to the longitudinal axis of the ball bat 10 than in Zone 3, and the thickness of one or more barrel walls in Zone 1 and/or Zone 2 may be less than the thickness of the barrel wall(s) in Zone 3. Additionally, one or more materials located in portions of Zone 1 and/or Zone 2 may have a lower radial stiffness than material(s) located in Zone 3, and/or one or more materials having a higher radial stiffness may be located in Zone 3. Any conceivable combination of these features, or any other methods for increasing radial compliance away from the bat's sweet spot, may be utilized to optimize barrel performance.

For ease of description, barrel regions exhibiting increased radial compliance, via any of the above methods, or any other suitable methods, will hereinafter be referred to as "radial compliance regions." Radial compliance regions may also be included in the tapered section 16 and/or the bat handle 12 of the ball bat 10, to provide increase radial compliance and deflection in those areas.

Locating one or more radial compliance regions in the tapered section 16 of the ball bat 10 provides higher bat deformation for off-barrel hits. By adding one or more radial compliance regions in the tapered section 16 of the ball bat 10, the performance of the bat 10, when ball impact occurs at the tapered section 16, will generally be improved, similar to the improvement in Zones 1 and 2 of the bat barrel 14, as described above.

Locating one or more radial/axial compliance regions in the bat handle 12 generally improves the "feel" of the bat 10, since a greater number of interfaces are provided for dissipating vibrational energy through dampening. The bat handle 12 also stores and releases energy in the form of bending and shear deformation. Accordingly, higher energy transfer can be realized by allowing the handle 12 to deform to a greater extent, via selective placement of radial compliance regions, upon the application of acceleration (i.e., upon swinging of the bat). In much the same manner used to tune the "dynamically coupled" barrel 14 described above, the handle 12 may be tuned for a specific player's swing style.

Some players may actually prefer higher radial stiffness region(s), i.e., regions having lower radial compliance, in the bat handle 12 near the tapered section 16 of the ball bat 10. Providing increased radial stiffness near the tapered section 16 allows the bat 10 to "snap back" to axial alignment more quickly during a swing than if lower radial stiffness is provided in that region. This quicker snap back is generally preferred by skilled players who generate high swing speeds. Locating radial compliance regions in the handle 12 near the tapered section 16, therefore, tends to rob skilled players of control, as the bat 10 is too slow to return to its axial position at or just prior to the time of ball impact.

For novice players, or players who generate lower swing speeds, however, it may be preferable to provide radial compliance region(s) adjacent to the tapered section 16 of the ball bat 10. Lesser-skilled players tend to "push" the bat through the strike zone, and therefore do not cause the bat 10 to "bend" significantly out of axial alignment. Additionally, it is generally desirable to locate radial compliance region(s) in the bat handle 12 closer to the user grip location, to improve the feel of the bat 10 during a swing. Those skilled in the art, therefore, will recognize that the optimal positioning of radial compliance regions in the bat handle 12 is generally dependent upon the flexibility of the remaining handle 12, the weight of the bat barrel 14, the skill level of the intended user, and the materials used in the handle 12.

Thus, radial compliance regions may be included in the barrel 14, the tapered section 16, and/or the handle 12 of the ball bat 10, to improve the overall performance and feel of the ball bat 10. Similarly, radial compliance may be reduced in regions not requiring increased radial compliance, such as in regions at or near the sweet spot of the bat barrel 14, and/or in the handle 12 near the tapered section 16, for players who generate high swing speeds. Reducing radial compliance in certain regions of the barrel 14 may be desirable, for example, to meet baseball association safety standards or other safety rules.

The ball bat 10 may be constructed in any suitable manner. In one embodiment, the ball bat 10 is constructed by rolling the various layers of the bat 10 onto a mandrel or similar structure having the desired bat shape. The radial compliance regions, and any ISCZs, are preferably strategically created, placed, located, and/or oriented, as described in the above embodiments, to achieve increased performance and trampoline effect in Zone 1 and/or Zone 2, relative to Zone 3, of the bat barrel 14. Additionally, radial compliance regions may be created, placed, located, and/or oriented in the tapered section 16, and/or the handle 12 of the ball bat 10 to increase deflection in those regions, as described above.

The ends of the material layers are preferably "clocked," or offset, from one another so that they do not all terminate at the same location before curing. Additionally, if varying layer orientations and/or wall thicknesses are used, the layers may be staggered, feathered, or otherwise angled or manipulated to form the desired bat shape. Accordingly, when heat and pressure are applied to cure the bat 10, the various layers blend together into a distinctive "one-piece," or integral, construction, as described above.

Put another way, all of the layers of the bat are "co-cured" in a single step, and blend or terminate together at at least one end, resulting in a single-piece structure with no gaps (at the at least one end), such that the barrel 14 is not made up of a series of tubes, each with a wall thickness that terminates at the ends of the tubes. As a result, all of the layers act in unison under loading conditions, such as during striking of a ball. One or both ends of the barrel 14 may terminate together in this manner to form a one-piece barrel 14, including one or more barrel walls (depending on whether any ISCZs are used). In an alternative design, neither end of the barrel is blended together in this manner.

The described bat construction, and method of making the same, provides a ball bat 10 exhibiting excellent performance, or "trampoline effect," throughout the length of the barrel 14. These results are primarily due to the selection, orientation, and/or strategic placement of radial compliance regions in the barrel 14, the tapered section 16, and/or the handle 12 of the bat 10, to increase deflection in those regions. Additionally, the optional step of blending the barrel layers together in a single curing step provides for increased durability, especially during impact at the extreme ends of the barrel layers.

FIG. 6 shows a graphical comparison of the relative performance characteristics of a typical double-wall bat barrel (the double-wall barrel curve in the graph of FIG. 6 is the same as the double-wall barrel curve shown in the graph of FIG. 2), and an optimized bat barrel 14 having radial compliance regions in Zones 1 and 2 of the bat barrel 14, as described above. As FIG. 6 illustrates, by increasing radial compliance in Zones 1 and 2 of the bat barrel 14, performance is generally improved throughout the length of the barrel 14, as compared to a typical double-wall bat.

Importantly, the termination of any radial compliance region need not occur specifically where two Zones meet. Indeed, a radial compliance region may overlap, or reside in, more than one Zone, and the Zones may be wider or narrower than those which are depicted in the drawings. Moreover, a greater or lesser number of Zones may be specified. Indeed, the "Zones" are used for illustrative purposes only, and do not provide a physical or theoretical barrier of any kind. Thus, radial compliance regions may be positioned, oriented, and/or or created in the bat barrel 14 (as well as in the tapered section 16 and the handle 12) at a wide variety of locations, according to an infinite number of designs, to achieve desired barrel and overall ball bat performance characteristics.

To this end, the invention is generally directed to a ball bat having increased radial compliance in at least one barrel region located away from the sweet spot of the barrel, to optimize the performance of the bat. Additionally, in one embodiment, it is preferable to increase the radial compliance to a greater extent in the barrel region between the tapered section of the bat and the sweet spot, than in the barrel region between the sweet spot and the free end of the barrel, to compensate for the different effects of rotational inertia in those regions. It is recognized, however, that radial compliance may be increased (or decreased) in any regions of the barrel (and/or other portions of the ball bat), in any suitable configuration, depending on the design goals for a particular ball bat.

Thus, while several embodiments have been shown and described, various changes and substitutions may of course be made, without departing from the spirit and scope of the invention. The invention, therefore, should not be limited, except by the following claims and their equivalents.

What is claimed is:

1. A ball bat including a barrel, a handle, and a tapered section joining the barrel to the handle, comprising:

a first non-metallic, composite region in the barrel, adjacent to the tapered section;

a second non-metallic, composite region in the barrel, adjacent to a free end of the barrel;

a third non-metallic, composite region in the barrel, between the first and second regions, including the sweet spot of the barrel, wherein the barrel includes a region of maximum radial stiffness located approximately at the sweet spot;

wherein the radial stiffness of the barrel is asymmetrical about the region of maximum radial stiffness, with the radial stiffness decreasing more rapidly toward the tapered section than toward the free end of the barrel.

2. The ball bat of claim 1 wherein the barrel is not reinforced by an insert.

3. The ball bat of claim 1, wherein the first, second, and third regions all include the same material, and wherein plies of the material are oriented at different angles relative to a longitudinal axis of the bat, in each of the first, second, and third regions, such that the radial stiffness of the barrel varies in each of the first, second, and third regions.

4. The ball bat of claim 3 wherein plies in the first region are oriented at a lesser angle from a longitudinal axis of the bat than plies in the second region, and plies in the second region are oriented at a lesser angle from the longitudinal axis of the bat than plies in the third region.

5. The ball bat of claim 1, wherein a thickness of at least one barrel wall is less in the first region than in the third region.

6. The ball bat of claim 5 wherein a thickness of the at least one barrel wall is less in the second region than in the third region.

7. The ball bat of claim 1, wherein the radial stiffness in at least a portion of the first region is less than 1000 pounds per inch, and the radial stiffness in at least a portion of the second region is less than 2000 pounds per inch.

8. The ball bat of claim 1, wherein the radial stiffness at the region of maximum radial stiffness is at least three times greater than the radial stiffness in the first region.

9. The ball bat of claim 1, wherein the radial stiffness at the region of maximum radial stiffness is at least 1.5 times greater than the radial stiffness in the second region.

10. The ball bat of claim 1, wherein different materials, having different radial stiffness properties, are located in at least two of the first, second, and third regions.

11. The ball bat of claim 1, wherein the barrel comprises at least one composite material selected from the group consisting of glass, graphite, boron, carbon, aramid, and ceramic.

12. The ball bat of claim 1, wherein the first region in the barrel extends into the tapered section of the ball bat.

13. The ball bat of claim 1, further comprising at least one ISCZ dividing the barrel into at least two walls.

14. A ball bat including a barrel, a handle, and a tapered section joining the barrel to the handle, comprising:

a first location in the barrel, adjacent to the tapered section, having a first radial stiffness;

a second location in the barrel, at a free end of the barrel, having a second radial stiffness that is greater than the first radial stiffness; and a third location in the barrel, between the first and second locations, including a point of maximum radial stiffness in the barrel;

wherein, from the point of maximum radial stiffness, the radial stiffness of the barrel decreases more rapidly toward the first location than toward the second location.

15. The ball bat of claim 14 wherein the radial stiffness of the barrel is at least 1.5 times greater at the point of maximum radial stiffness than at the second location, and at least three times greater at the point of maximum radial stiffness than at the first location.

16. The ball bat of claim 14 wherein the barrel is not reinforced by an insert.

17. The ball bat of claim 14 wherein the point of maximum radial stiffness is located at a sweet spot of the barrel.

18. A ball bat, comprising:

a handle;

a barrel including a point of maximum radial stiffness; and a tapered section joining the handle to the barrel;

wherein the radial stiffness of the barrel is asymmetrical about the point of maximum radial stiffness, with the radial stiffness decreasing more rapidly, and to a greater extent, toward the tapered section than toward a free end of the barrel.

19. The ball bat of claim 18 wherein the barrel is not reinforced by an insert.

20. The ball bat of claim 18 wherein the point of maximum radial stiffness is located at a sweet spot of the barrel.

* * * * *